United States Patent [19]

Balmuth

[11] 4,248,630

[45] Feb. 3, 1981

[54] METHOD OF ADDING ALLOY ADDITIONS IN MELTING ALUMINUM BASE ALLOYS FOR INGOT CASTING

[75] Inventor: Edward S. Balmuth, Arlington, Va.

[73] Assignee: The United States of America as represented by the Secretary of the Navy, Washington, D.C.

[21] Appl. No.: 73,359

[22] Filed: Sep. 7, 1979

[51] Int. Cl.[3] ..... C22C 1/03

[52] U.S. Cl. ..... 75/135; 75/138

[58] Field of Search ..... 75/138, 68 R, 148, 164, 75/135

[56] References Cited

U.S. PATENT DOCUMENTS

| | | | |
|---|---|---|---|
| 3,895,937 | 7/1975 | Gjosteen et al. | 75/68 R |
| 4,080,200 | 3/1978 | Sheridan | 75/138 |
| 4,138,246 | 2/1979 | Buxmann et al. | 75/68 R |

*Primary Examiner*—M. J. Andrews

*Attorney, Agent, or Firm*—R. S. Sciascia; Sol Sheinbein

[57] ABSTRACT

A method of adding alloying elements, including highly reactive metals such as lithium, to molten aluminum so that the normally occurring oxidation reaction of such elements with the atmosphere is minimized. After adding all alloying elements, except the highly reactive metals, to the molten aluminum, and after the alloyed melt has been subjected to a degassing and filtering process, the reactive metals are introduced in a mixing crucible as the final step prior to the casting operation. The desired concentration of reactive metal in the melt is achieved by controlling the relative amounts of reactive metal and alloyed melt. Uniformity of the mixture is controlled by mechanical stirring. The alloyed metal is then cast into ingots.

16 Claims, 3 Drawing Figures

METHOD OF ADDING ALLOY ADDITIONS IN MELTING ALUMINUM BASE ALLOYS FOR INGOT CASTING

BACKGROUND OF THE INVENTION

The present invention relates to methods of making aluminum alloys, and more particularly to a method of alloying aluminum with highly reactive metallic elements which tend to increase the oxidation rate of the melt, as for example, lithium.

Prior methods for melting aluminum alloys in preparation for ingot casting practices generally employ the addition of alloying elements to the aluminum melt in large melting furnaces. While minor alloying elements such as titanium-boron may be added at some point after the molten metal has left the melting furnace, this method is not employed for major alloying elements where concentrations of such elements must be carefully controlled. One of the major problems encountered with prior art alloying methods is that hydrogen is absorbed by the molten metal as a result of the reaction between the melt and the moisture in the air in the open furnaces. To minimize oxidation reactions, molten salt flux has been used on top of the molten metal. Yet even where the flux has been employed, large concentrations of hydrogen are found in the melt, and, unless removed, cause an unacceptable degree of porosity in the ingots. This "degassing", as the practice is commonly known in the art, is accomplished by bubbling a gas, usually containing chlorine, through the melt. A final degassing may be performed in a smaller holding furnace located closer to the casting station.

When lithium is used as an alloying element, it can only be added after all degassing has been completed. Lithium is added in either a solid or liquid state to the melting furnace or to the smaller holding furnace. In either case, it must be held under the surface of the melt until it dissolves.

Many difficulties have been encountered with lithium additions. Principally lithium has been found to significantly increase the oxidation rate of the melt. Lithium also contaminates the refractories in the furnace lining, making the furnace unsuitable for melting lithium-free alloys without a costly relining of the furnace. Special refractories and materials which are resistant to attack by lithium must be used throughout the melting and metal transfer stages. Moreover, the aluminum melt cannot be effectively degassed after the lithium is added without a resulting loss of much of the lithium. Thus because of the increased rate of oxidation after the addition of lithium, as well as the long holding time before all the metal finally solidifies in the ingot, significant loss of the costly lithium is very probable, and control of the desired concentration of lithium becomes critical. Another problem encountered concerns the considerable quantities of hydrogen which are absorbed by the melt after the lithium is introduced. Stirring the melt, after addition of the lithium, is performed to encourage uniformity of the composition, but in fact disrupts the protective cover of flux and results in further oxidation and hydrogen absorption. One proposed method for controlling this undesired oxidation involves covering the entire system (melting furnace, metal transfer troughs, holding furnace, and ingot casting station) and maintaining a dry, inert atmosphere over the molten metal. Unfortunately, implementation of this method would require redesign and reconstruction of the furnaces. Use of the method would also complicate control and monitoring of the casting procedures and equipment, and would be financially prohibitive.

SUMMARY OF THE INVENTION

Accordingly, the method of the present invention provides for the addition to molten aluminum of alloying elements, including elements of a kind which are highly reactive, and which tend to increase the oxidation rate of the melt. The addition of these highly reactive elements occurs after all other major alloying additions have been made, after the alloy melt has been degassed and filtered to remove undesirable hydrogen and dross, respectively, and just prior to ingot casting. After each reactive metallic element to be added is reduced to a molten state, it is blended with the degassed and filtered alloy melt in a mixing crucible located upstream of the casting station. As a result of the short period of time during which the blended alloy is held prior to casting, the degree of oxidation of the melt is minimized.

OBJECTS OF THE INVENTION

It is therefore an object of this invention to provide a novel method for the formation of an alloy including aluminum and a highly reactive metallic element, such as lithium.

Another object of the present invention is to provide a method of adding alloying elements, including highly reactive metals, such as lithium, to molten aluminum so that the normally occurring oxidation reaction of such elements with the atmosphere is minimized.

Yet another object of this invention is to provide a method for making an aluminum alloy where a highly reactive metallic element, such as lithium, is alloyed with the aluminum after all other major alloying elements have been added and after undesired hydrogen gas has been removed from the alloy melt.

Still another object of this invention is to provide a method for making an aluminum alloy in which the addition of a highly reactive metallic element after degassing and filtering of the aluminum alloy melt minimizes the oxidation of the melt with the atmosphere.

Another object of this invention is to provide a method of adding alloying elements, including highly reactive metals, such as lithium, to molten aluminum so that contamination of the refractories of large furnaces with lithium is avoided.

BRIEF DESCRIPTION OF THE DRAWINGS

Other objects and many of the attendant advantages of this invention will be appreciated as the same becomes better understood by reference to the following detailed description when considered in connection with the accompanying drawings in which like reference numerals designate like parts throughout the figures thereof and wherein.

DESCRIPTION OF THE PRIOR ART

Figure 1:
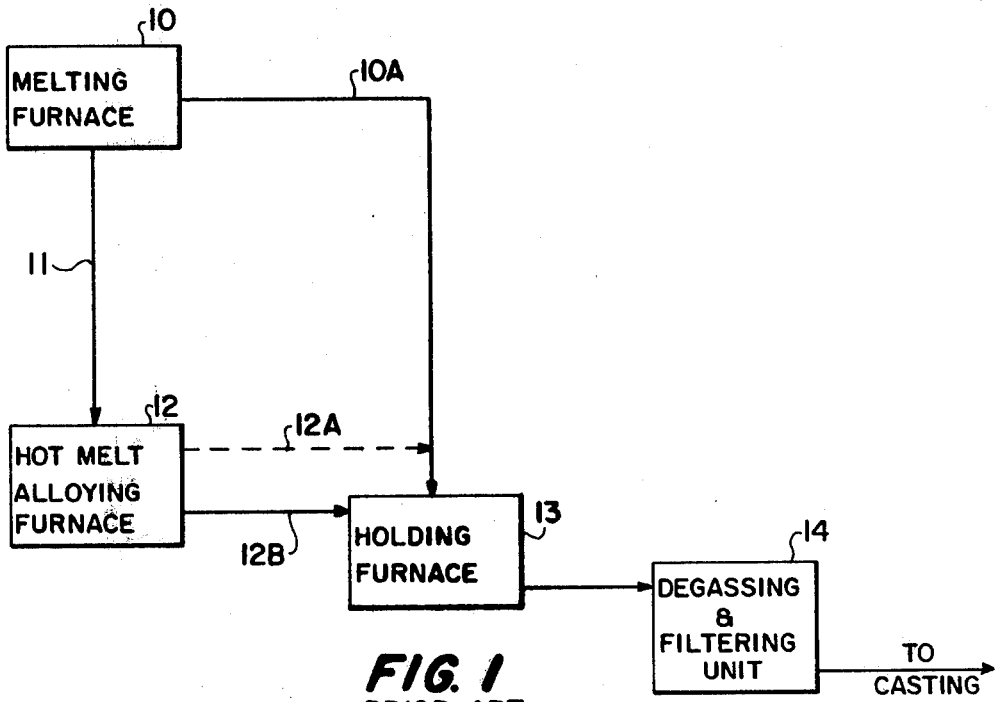
FIG. 1 PRIOR ART
FIG. 1 is a block diagram representing one process well-known in the prior art for combining aluminum with nonreactive alloying elements.

Referring to the drawings, FIG. 1 is a block diagram of a process for forming an aluminum alloy. The figure illustrates a conventional method (Note Sheridan, U.S. Pat. No. 4,080,200) for making an alloy of aluminum and manganese, in which aluminum is melted in melting furnace 10 and maintained at a selected temperature. An aliquot portion of molten aluminum 11 is transferred to hot melt alloying furnace 12, and pieces of electrolytic manganese are charged to the hot melt furnace to provide a composition of about 50% by weight of manganese. The molten charge in the hot melt furnace is heated to a high temperature and stirred to aid in the dissolution of the managese. The stirring is conducted under inert conditions e.g., an atmosphere of nitrogen. Various methods of stirring molten metal, e.g., molten aluminum, are known and available to those skilled in the art. The remainder of the host metal is transferred from the melting furnace 10 to holding furnace 13 via transfer line 10A. The hot melt master alloy is blended with the remaining host metal in holding furnace 13 via either transfer line 12A fed into line 10A or by line 12B directly to the holding furnace as shown, wherein the desired final composition is obtained. Prior to casting the aluminum alloy, the alloy is degassed and filtered at 14 in the conventional manner. In removing the aliquot portion from the furnace, the portion is removed from below the surface of the melt to avoid feeding dross into the hot melt furnace. Where the hot melt is not produced under inert conditions, it may be necessary to filter out any dross that forms before adding the hot master alloy to the host metal.

The solute metals included within the scope of the invention are selected from the group consisting of Fe, Ni, Co, Mn, Nb, Ti, Zr, Hf, W, Cr, Mo and Si. Each are slowly soluble in aluminum, and none promote oxidation as does lithium. More importantly, the FIG. 1 prior art process prohibits alloying aluminum with a highly reactive metal, such as lithium, since that process provides for degassing the melt after all alloying elements have been added.

DESCRIPTION OF THE PREFERRED EMBODIMENT

Figure 2:
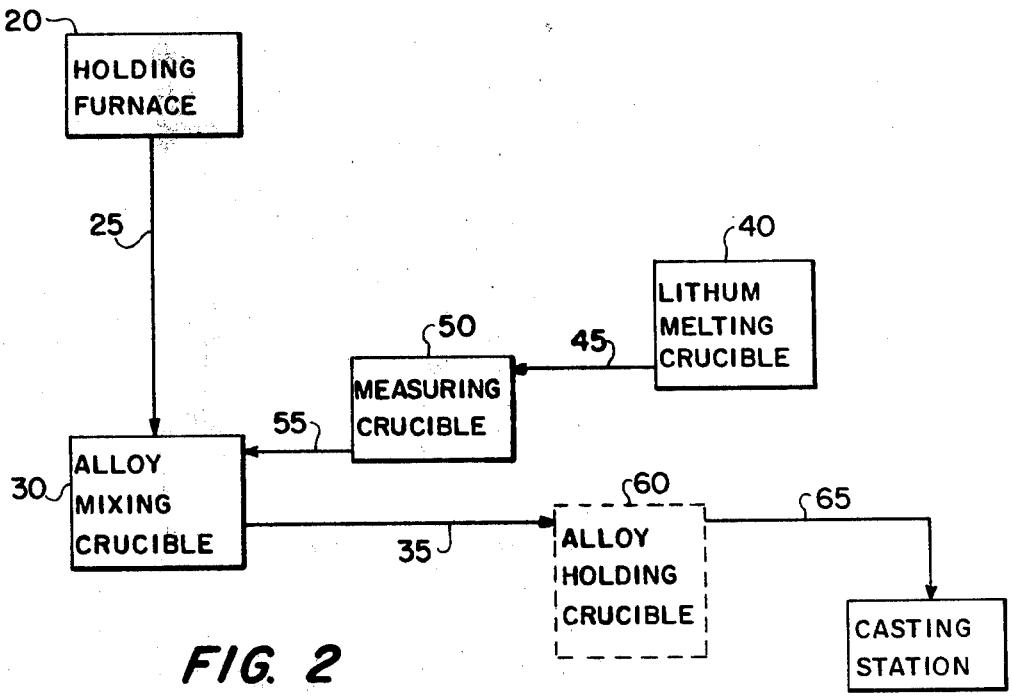
FIG. 2 is a block diagram representing the present process for combining aluminum with lithium, a highly reactive metallic alloying element.
Figure 3:
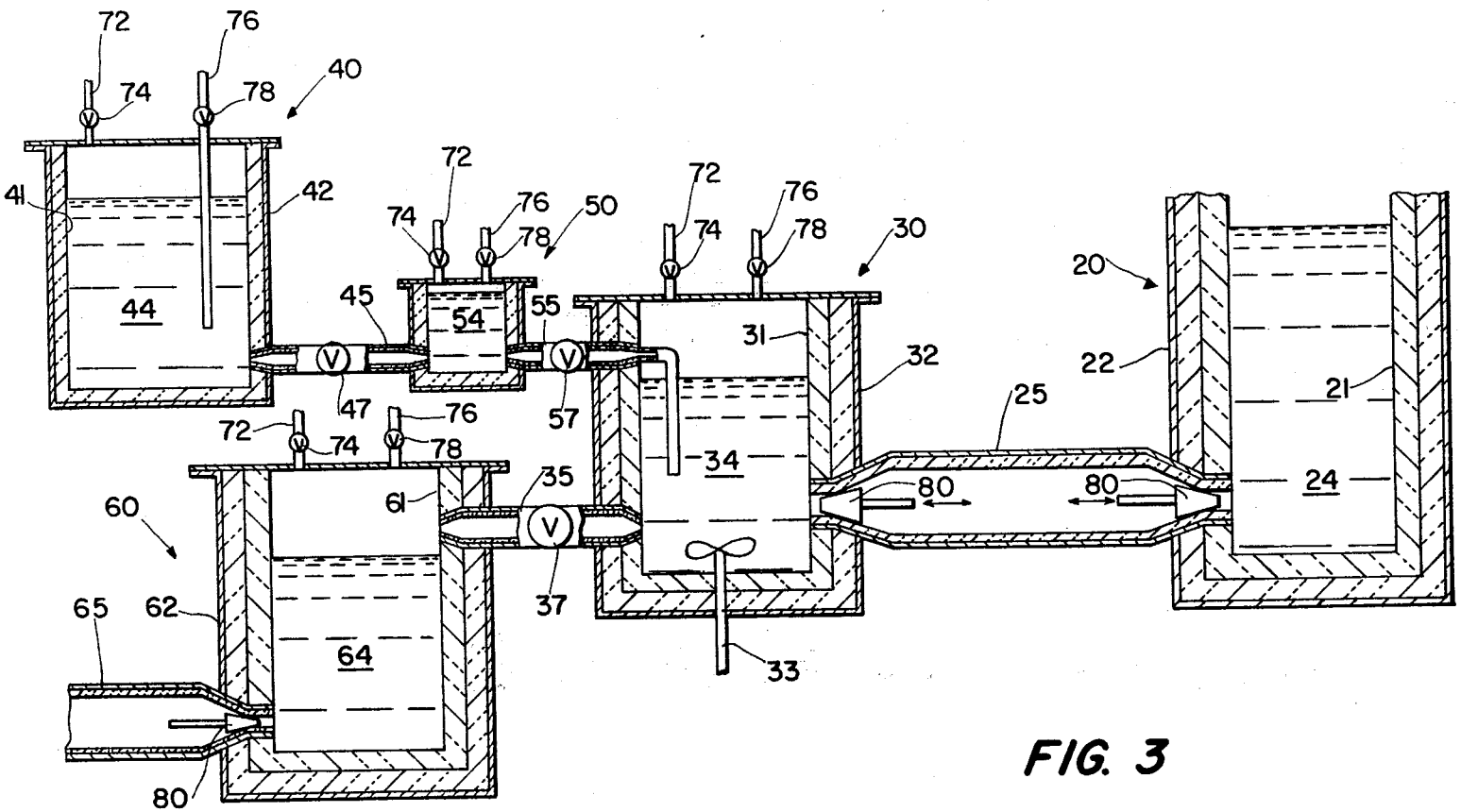
FIG. 3 illustrates the apparatus utilized in making the aluminum-lithium alloy.

FIGS. 2 and 3 of the drawings depict the method, and apparatus respectively, for implementation of the present invention.

FIG. 2 is set out in block diagram format, and illustrates the steps involved in carrying out the instant method where the reactive element is lithium. After degassing and filtering an aluminum alloy melt in holding furnace 20 in a conventional manner, a measured portion of melt, which contains all alloying elements additions except highly reactive metallic elements (in this case lithium), is transferred via trough 25 to alloy mixing crucible 30 in preparation for addition thereto of the lithium. The latter is reduced in melting crucible 40 to molten state, and is carried via transfer tube 45 to measuring crucible 50, where a predetermined amount of molten lithium is carried via transfer tube 55 and admitted to alloy mixing crucible 30. Here the molten lithium and aluminum are blended together. From mixing crucible 30, the melt is either transferred by trough 35 to a casting station, or to holding crucible 60 and then to the casting station via through trough 65. FIG. 3 illustrates apparatus employed in carrying out the instant method. Reduction of aluminum pigs to a molten bath takes place in a conventional manner as does the addition of all alloying elements except lithium. Degassing and filtering of the alloy melt is also carried out in a manner well-known in the prior art for lithium-free alloys. This degassing is generally performed while melt 24 is in holding furnace 20. The melt in the holding furnace 20 is fed through trough 25, which includes one stopper 80 at each end for controlling flow of alloy melt therethrough. Trough 25 carries melt 24 from holding furnace 20 to alloy mixing crucible 30. A quantity of molten aluminum is admitted to mixing crucible 30, the amount of which depends on the capacity of the crucible.

Crucible 40 is employed to reduce lithium ingots to lithium melt 44. A quantity of lithium sufficient to complete an ingot casting cycle is initially melted down in the lithium melting crucible. The crucible may be heated by induction, resistance heating, or other conventional devices, but in any case must be heated to a sufficiently high temperature to assure fluidity of the lithium 44 in transfer tubes 45 and 55, which also are heated or insulated, as required, to prevent freezing, i.e. solidification, of the metal in the tubes. Upon reaching a preselected temperature and after a sufficient amount of time, valve 47 in transfer tube 45 is opened and a preselected amount of molten lithium 44 is admitted to mixing crucible 30. This is accomplished by using either a flow metering device (not shown) or measuring crucible 50. By filling the measuring crucible with a predetermined amount of molten lithium, and permitting only that amount of molten lithium, to enter mixing crucible 30, any preselected concentration of lithium in the alloy is attainable by controlling the proportion of lithium, relative to the amount of aluminum, in mixing crucible 30. As a less desirable alternative to utilizing measuring crucible 50, the flow of lithium may be metered directly into mixing crucible 30 in a conventional manner.

When the desired amount of molten lithium has been defined, it is then transferred through opened valve 57 of transfer tube 55 into mixing crucible 30 under the influence of either gravity or gas pressure. In mixing crucible 30, the lithium melt and the aluminum alloy melt from holding furnace 20 are blended together by using mechanical stirring device 33. Metal 34 is then released through open valve 37, and the trough 65 to a casting station. A filter unit (not shown) may be used, if desired, in combination with trough 35, provided the filter media is selected to be resistant to attack by the molten aluminum lithium. Mixing crucible 30 is refilled upon becoming empty.

In this process where the measuring crucible 50 is employed, the mixing of lithium and aluminum is done repetitively as the ingots solidify and more molten metal is required. This incremental method of mixing a relatively small amount of lithium at any one time will result in a constantly varying height of the molten metal head over the ingot. When this effect is undesirable, a true level pour system can be achieved by the addition of holding crucible 60 and releasing the metal from mixing crucible 30 to holding crucible 60 at once, and then releasing the metal 64 in crucible 60 to trough 65 to the ingot casting station at a controlled rate as may be accomplished with a float operated metering system.

Each of lithium melting crucible 40, measuring crucible 50 (if used), and transfer tubes 45 and 55 are metal shells lined with refractory or other materials (41 and 51 shown in FIG. 3) suitable for resisting attack by the molten lithium. Moreover, each of melting furnace 20, mixing crucible 30, holding crucible 60 and troughs 25, 35 and 65 are lined with refractory materials which are resistant to attack from both the molten lithium and the molten aluminum.

The molten lithium 44 may be treated, if desired, while in covered crucibles 40, 50 (when used) 30, and 60 (when used) by bubbling inert gas into tubes 76 when valves 78 are open, and out of the crucibles through tubes 72 when valves 74 open. In so doing, dissolved gases and high vapor pressure contaminants, such as potassium and sodium, are removed. A vacuum, of inert atmosphere, such as argon, is maintained in lithium melting crucible 40, measuring crucible 50 (when used), mixing crucible 30 and alloy holding crucible 60 (when used). The inert atmosphere may be initially established by conventional means such as purging or by drawing a vacuum and back-filling with inert gas. An inert gas atmosphere is preferred over a vacuum because of the relatively high vapor pressure of lithium. The ingot pouring trough and ingots may be covered with, and maintained under, an inert atmosphere, or the molten metal may be covered with a protective salt flux, as in the usual practice. A filter screen may be used over the ingot casting station to remove dross or other coarse inclusions, as in the usual practice.

The alloy mixing and holding crucibles are equivalent in size. The capacity of these crucibles need only be a fraction of the quantity of ingot to be cast but at least of sufficient capacity to assure a smooth operation in the repetitive process of mixing the lithium and aluminum. Multiple mixing crucibles may be used as an alternative to holding crucible 60, or multiple smaller mixing crucibles may be used in conjunction with a holding crucible.

Metal casting temperature may be controlled by controlling the temperature in the holding furnace or by heating the alloy mixing crucible or holding crucible. Clean scrap metal containing lithium may be melted in a separate crucible under an inert atmosphere and then fed to the holding crucible with a quantity of virgin material from the mixing crucible. Dirty scrap should be reprocessed before its addition to the melt.

This invention is intended to be primarily applicable to the addition of lithium to aluminum alloys. However, it is also suitable for the addition of other alloying elements such as magnesium, which, like lithium, is a highly reactive metal and significantly increases the oxidation rate of the melt. Other common alloying elements such as silicon and zinc tend to contaminate the melting furnace, requiring a costly cleaning process when alloys, which do not tolerate these elements, are to be subsequently melted. Addition of these elements by the process described herein prevents the contamination of the major equipment. When elements such as silicon or zinc are to be added, the inert atmosphere may not be necessary.

There has therefore been described a method of alloying aluminum with highly reactive metallic elements, such as lithium, so that the resulting aluminum alloy possesses lower density along with a higher modulus of stiffness. These reactive metallic elements are of the kind which substantially increase the rate of oxidation of the alloy melt after their addition thereto. The method prescribes that the alloy melt be degassed and filtered, to eliminate undesirable hydrogen and inclusions, respectively prior to the augmentation of the alloy melt with the molten metallic element. As a result of the shortened holding time of the blended melts, the tendency for the alloy melt to oxidize is minimized, and the volatility of the reactive melt is effectively reduced. In this way, oxidation of the melt is minimized not only as a result of the short holding time of the alloy augmented melt prior to solidification in ingot casting, but also through the utilization of protective atmospheres. Moreover, hydrogen absorption, which results in undesirable porosity in the ingot, is minimized concurrent with reduced oxidation.

The method of the present invention is further advantageous inasmuch as it facilitates control over the concentration of reactive metallic elements in the final ingot. The process for adding the reactive element may be automated. Thus the need for holding the element under the melt manually as well as the hazard of undissolved reactive element pieces floating to the surface and igniting is obviated. The method further permits the use of large capital equipment, such as melting or holding furnaces, without extensive modification. Moreover, equipment needed to effect this process can readily be integrated with existing equipment for melting, degassing, filtering and casting. In the eventuality that a casting drop is disrupted by equipment malfunction or ingot cracking, there is no large quantity of reactive metal containing alloy which must be held and protected from oxidation while the problem is being corrected.

Obviously many modifications and variations of the present invention are possible in the light of the above teachings. It is therefore to be understood that, within the scope of the appended claims, the invention may be practiced otherwise than as specifically described.

What is claimed is:

1. The method of making an aluminum alloy containing aluminum and alloying elements including a highly reactive metallic element, comprising:

establishing a bath of molten aluminum;

adding all alloying elements to said bath except said highly reactive metallic element, thereby establishing an alloy melt, treating said alloy melt to remove hydrogen gases therefrom, and combining said reactive metallic element with said treated alloy melt, whereby the addition of said reactive metallic element to said melt after treating said melt ensures minimization of the oxidation rate of the melt.

2. The method as set forth in claim 1 wherein said step of treating includes degassing said alloy melt and said step of combining comprises:

melting said highly reactive metallic element in a melting furnace, and blending said reactive element melt with said treated alloy melt.

3. The method of claim 2 wherein said step of blending includes stirring said reactive element melt and said degassed alloy melt.

4. The method of claim 2 wherein said step of combining further includes metering a predetermined amount of said molten reactive element out of said melting furnace.

5. A method of combining aluminum with alloying elements comprising the steps of melting said aluminum, combining said aluminum with at least one alloying element to form an alloy melt, degassing said melt to substantially remove hydrogen therefrom, adding a quantity of a highly reactive metallic element to said substantially degassed alloy melt, and casting the melt.

6. The method of claim 5 wherein said step of introducing comprises melting said reactive element.

7. The method of claim 5 wherein said step of introducing further includes measuring out a portion of said melted reactive element for addition to said alloy melt.

8. The method of claim 6 wherein said step of introducing includes mixing said melted reactive element with said alloy melt.

9. The method of claim 8 wherein said step of mixing includes stirring said alloy melt as said melted reactive element is added thereto.

10. The method as set forth in claim 5 wherein the step of adding of a highly reactive metallic element comprises adding lithium.

11. A method for making an aluminum alloy containing aluminum and at least two metallic substances, at least one of said metallic substances being highly reactive which would significantly increase the oxidation rate of the alloy when in its molten form, at least one other of said metallic substances having a relatively low reactance with oxygen which would not significantly change the oxidation rate of the molten alloy when added to the aluminum, wherein the method comprises the steps of:

melting said aluminum to form a melt;

adding said at least one other metallic substance to said melt;

degassing said melt to substantially remove any contaminating substance in gaseous form therefrom;

adding a measured quantity of melted highly reactive metallic substance to said melt while treating said melt and mixing said melt to substantially blend said highly reactive metallic substance with said melt;

casting said melt.

12. The method as set forth in claim 11 wherein the step of degassing comprises degassing to substantially remove hydrogen.

13. The method as set forth in claim 11 or 12 wherein the at least one other of said metallic substances is selected from a group consisting of Fe, Ni, Co, Mn, Nb, Ti, Zr, Hf, W, Cr, Mo, and Si.

14. The method as set forth in claim 13 wherein the at least one highly reactive metallic substance includes lithium.

15. The method as set forth in claim 14 wherein the step of degassing said melt includes degassing said melt in a holding furnace, and the step of adding a measured quantity of said highly reactive substance includes melting said highly reactive substance in a melting crucible and measuring said highly reactive substance in a measuring crucible which is substantially enclosed and has an inert atmosphere; and the step of mixing the melt includes mixing said highly reactive substance with said melt in an alloy mixing crucible which is substantially enclosed and has an inert gas atmosphere.

16. The method as set forth in claim 14 wherein the treating of said melt after the lithium has been added includes bubbling inert gas through the melt to remove dissolved gases and high pressure contaminates.

* * * * *